US005791987A

United States Patent [19]

Chen et al.

[11] Patent Number: 5,791,987

[45] Date of Patent: Aug. 11, 1998

[54] METHOD FOR USERS TO PLAY THE KUNG-MING CHESS ON MICRO-PROCESSOR-BASED SYSTEMS

[75] Inventors: Huai-Yen Fred Chen, Chung-Ho; Wen-Kang Andrew Li, Shang-Hai; Yu-Ying Anita Liang, Shi-Lin, all of Taiwan

[73] Assignee: Inventec Corporation, Taipei, Taiwan

[21] Appl. No.: 643,897

[22] Filed: May 7, 1996

[51] Int. Cl.[6] ..... A63F 3/00

[52] U.S. Cl. ..... 463/9; 463/14; 273/237; 273/261; 273/281

[58] Field of Search ..... 273/237, 238, 273/260, 261, 281; 463/9, 14

[56] References Cited

U.S. PATENT DOCUMENTS 3,999,760 12/1976 Wilson ..... 273/260

OTHER PUBLICATIONS

"Sol" (CGI version) page prinouts, by Tom Gidden, available on the internet at http://www.gis-games.com/sol.html.

*Primary Examiner*—Jessica Harrison

*Attorney, Agent, or Firm*—Merchant, Gould, Smith, Edell, Welter & Schmidt

[57] ABSTRACT

A game software is devised for a user to play the Kung-Ming Chess on a microprocessor-based system having at least a CPU, a memory unit, a screen, and a cursor position control device. In playing the Kung-Ming Chess, the user plays on screen against a deployment selected from a predefined set of deployments stored in the database of the game software. Each deployment is entitled with the name of a particular stratagem originated from Chinese heritage. While playing the Kung-Ming Chess, the game software allows the user to learn these stratagems and related information.

13 Claims, 11 Drawing Sheets

| | Row | A | B | C | D | E | F | G | | |
|---|---|---|---|---|---|---|---|---|---|---|
| | Bit | 7 | 6 | 5 | 4 | 3 | 2 | 1 | 0 | |
| → | Byte 1 | X | X | 0 | 1 | 0 | X | X | X | 10 |
| → | Byte 2 | X | X | 0 | 1 | 0 | X | X | X | 10 |
| → | Byte 3 | 0 | 0 | 0 | 0 | 0 | 0 | 0 | X | 00 |
| → | Byte 4 | 0 | 1 | 1 | 1 | 1 | 1 | 0 | X | 7C |
| → | Byte 5 | 0 | 1 | 0 | 0 | 0 | 1 | 0 | X | 44 |
| → | Byte 6 | X | X | 1 | 1 | 1 | X | X | X | 38 |
| → | Byte 7 | X | X | 1 | 0 | 1 | X | X | X | 28 |

```
const char count[1050]=
{
0x00,0x10,0x38,0x10,0x10,0x00,0x00
0x00,0x00,0x44,0x54,0x28,0x00,0x00
0x00,0x00,0x00,0x10,0x38,0x38,0x00
0x00,0x00,0x04,0x0C,0x08,0x10,0x30
0x00,0x10,0x10,0x28,0x28,0x10,0x00
0x00,0x00,0x38,0x7c,0x00,0x00,0x00
0x00,0x10,0x60,0x0c,0x0c,0x10,0x00
0x10,0x10,0x00,0x6c,0x00,0x10,0x10
0x00,0x00,0x28,0x28,0x38,0x10,0x00
0x00,0x00,0x00,0x7c,0x10,0x10,0x10
0x00,0x00,0x0c,0x16,0x14,0x20,0x00
0x00,0x00,0x1c,0x1c,0x10,0x10,0x00
0x00,0x00,0x00,0x00,0x6c,0x38,0x10
0x00,0x10,0x10,0x7c,0x10,0x10,0x00
0x00,0x00,0x28,0x38,0x10,0x38,0x00
0x00,0x28,0x28,0x10,0x28,0x28,0x00
0x00,0x38,0x0c,0x12,0x0c,0x00,0x00
0x00,0x00,0x30,0x34,0x1c,0x08,0x00
0x10,0x38,0x38,0x10,0x10,0x10,0x00
0x00,0x10,0x6c,0x00,0x6c,0x10,0x00
0x00,0x00,0x38,0xd6,0x10,0x10,0x00
0x00,0x00,0x28,0x54,0x38,0x10,0x10
0x00,0x00,0x54,0x6c,0x28,0x10,0x00
0x10,0x38,0x38,0x38,0x00,0x00,0x00
0x00,0x00,0x0c,0x1e,0x1c,0x10,0x00
0x00,0x00,0x00,0x64,0x68,0x30,0x00
0x00,0x10,0x0c,0xc6,0x60,0x10,0x00
0x00,0x00,0x38,0x7c,0x38,0x00,0x00
0x00,0x10,0x10,0xd6,0x6c,0x00,0x00
0x10,0x10,0x00,0x6c,0x38,0x10,0x10
0x00,0x18,0x18,0x78,0x70,0x00,0x00
0x08,0x18,0x30,0x60,0xd8,0x00,0x00
0x00,0x10,0x00,0x38,0x0c,0x38,0x28
0x10,0x10,0xd4,0x38,0x28,0x00,0x00
0x38,0x38,0x38,0x28,0x00,0x00,0x00
0x00,0x38,0x30,0x2e,0x06,0x00,0x00
0x18,0x30,0x30,0x18,0x20,0x18,0x00
   :
}; ALL DEPLOYMENT
```

FIG.9

METHOD FOR USERS TO PLAY THE KUNG-MING CHESS ON MICRO-PROCESSOR-BASED SYSTEMS

BACKGROUND OF THE INVENTION

The present invention relates to game software, and more particularly, to a method for users to play the Kung-Ming Chess on a microprocessor-based system. The Kung-Ming Chess is originated in China and the background thereof will be described briefly in the following.

About the Kung-Ming Chess

Kung-Ming Chess is a board game originated in China. The game is named after Chuko Liang (Kung-Ming is his alias), who lived 181–234 A.D. and was the first prime minister of the Shu Kingdom during the Age of the Three Kingdoms in Chinese history. Chuko Liang was particularly noted for his great wisdom in devising stratagems and planning military deployments that help his kingdom compete and fight against the other two.

Referring to FIG. 1, the Kung-Ming Chess includes a chessboard with a cross-like array of 33 circles, each circle serving as a position on which a checker is selectively placed. A particular arrangement of a selected number of checkers on the chessboard is called a deployment. Various deployments are devised in advance for the game and an instance of which is shown in FIG. 2. The Kung-Ming Chess is essentially a one-player chessboard game played by just one player. The goal of the game is to "defeat" each deployment presented to the player. To successfully defeat a deployment, the player needs to figure out a sequence of moves, each move being carried out by scrupulously selecting any individual checker on the chessboard, moving it over any adjacent one to a forward empty position immediately next to the adjacent checker, and then removing the adjacent checker from the chessboard. Only horizontal or vertical moves but not diagonal moves are allowed. If the player is able to remove the checkers one by one until at last only one checker is left on the chessboard, the deployment is defeated and the player wins the game. Fundamentally, for a deployment of N checkers on the chessboard, the player needs to make exactly N−1 moves to successfully defeat the deployment.

For instance, in order to defeat the deployment of six checkers shown in FIG. 2, a feasible sequence of moves are shown in FIGS. 3A–3F, which includes the following moves:

(1) D3→F3, thus removing the checker on E3 (FIG. 3A);

(2) D5→D3, thus removing the checker on D4 (FIG. 3B);

(3) C3→E3, thus removing the checker on D3 (FIG. 3C);

(4) F3→D3, thus removing the checker on E3 (FIG. 3D); and (5) D2→D4, thus removing the checker on D3 (FIG. 3E).

After that, only one checker is left on the position D4 and therefore the player successfully defeats the deployment and wins the game.

On the other hand, if for instance in the foregoing Step (3) the player chooses instead to perform the move D2→D4 so as to remove D3, the chessboard will be left with three checkers as illustrated in FIG. 4. In this case, according to the rule of the game, the player is unable to further move any checkers on the chessboard and therefore the player fails to defeat the deployment and loses the game.

FIG. 5 shows another deployment on the chessboard. Interested readers can draw a chessboard as that shown in FIG. 1, place coins or the like as checkers on the chessboard according to the deployment shown in FIG. 5, and then try to figure out a sequence of moves that can defeat the deployment.

The Kung-Ming Chess normally comes with a predefined set of deployments for the player to play with. Traditionally, the Kung-Ming Chess is played in such a manner that one person devises various deployments for the other to find a way to defeat each deployment. Interested readers can devise various deployments according to the rule described above and try to find at least a winning sequence of moves for each deployment. Not all deployments have a solution though. If at least a solution is found for a particular deployment, the deployment can be recorded and later used to challenge others.

Traditionally, the Kung-Ming Chess is played on a chessboard, which is not a convenient way if the player is on the go. There exists therefore a need for an on-screen way of playing the Kung-Ming Chess on a portable microprocessor-based system.

SUMMARY OF THE INVENTION

It is a primary objective of the present invention to provide a method for players to play the Kung-Ming Chess on a microprocessor-based system against a predefined and stored set of deployments.

It is another objective of the present invention to provide a method for players to learn the Thirty-six Stratagems on a microprocessor-based system.

In accordance with the foregoing and other objectives of the present invention, a method for a user to play the Kung-Ming Chess and learn the Thirty-six Stratagems on a microprocessor-based system is provided. In playing the Kung-Ming Chess, the method according to the present invention comprises the following steps of: (1) displaying a Kung-Ming Chess chessboard having an array of checker boxes on the screen; (2) retrieving selectively a deployment of checkers from a database storing a predefined set of deployments and placing the selected deployment on the Kung-Ming Chess chessboard, each deployment being represented by at least seven bytes, each bit in said seven bytes representing whether a checker is to be placed on a corresponding position on the Kung-Ming Chess chessboard; (3) prompting the user to move the checkers on the Kung-Ming Chess chessboard; (4) making a move so as to displace a selected checker on a starting position over an adjacent checker to a destination position two checker boxes away from the starting position and then clearing the adjacent checker; and (5) repeating step (4) until the user defeat the deployment or more than two checkers are left on the chessboard but the user is unable to move any checkers.

BRIEF DESCRIPTION OF DRAWINGS

The present invention can be more fully understood by reading the subsequent detailed description of the preferred embodiments thereof with references made to the accompanying drawings, wherein:

FIG. 9 shows part of a Constant Table used to store the byte values of a predetermined set of deployments;

DETAILED DESCRIPTION OF PREFERRED EMBODIMENT

In the preferred embodiments described in the following, the Kung-Ming Chess video game is implemented on the CD65 microprocessor-based system, which is a packet-size computer available from the Inventec Corporation. However, it is to be understood that the present invention can be implemented on any microprocessor-based system having at least a CPU, a memory unit, a screen, and a cursor position control device. Furthermore, the game software specifically developed on the CD65 can be ported by means of a conversion program to other types of computers such as the IBM PC or compatibles running DOS and/or Windows operating system, the Macintosh computers, and so on.

Figure 6:
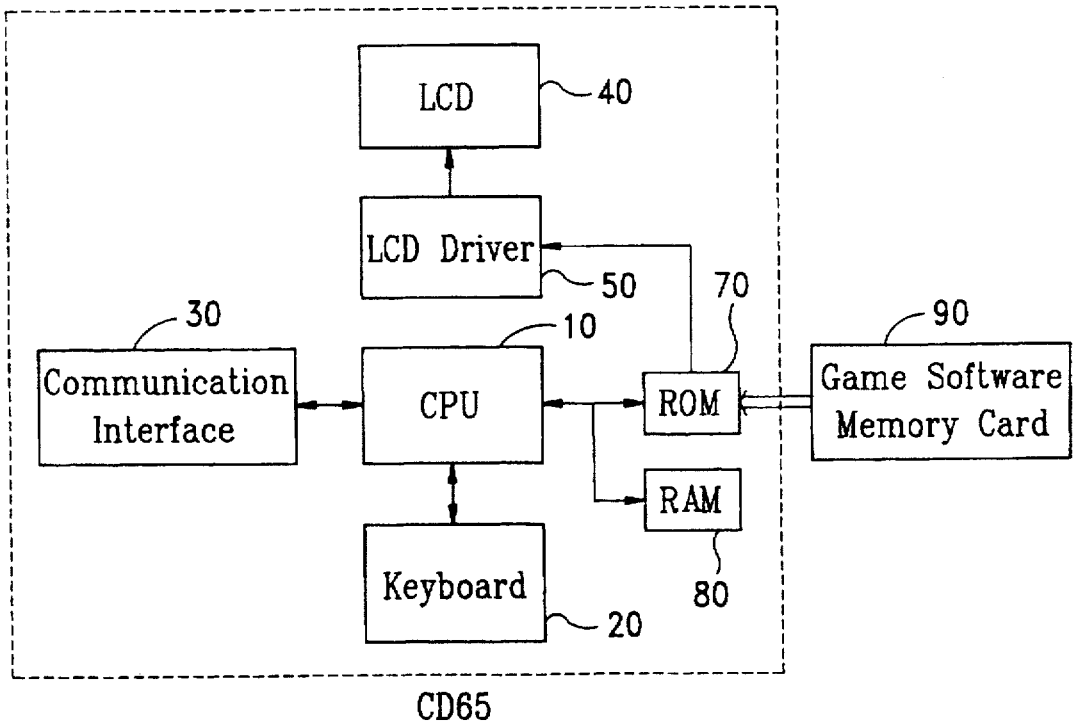
FIG. 6 shows the block diagram of a microprocessor-based system for executing the game software devised in accordance with the method of the present invention.

FIG. 6 shows the block diagram of the CD65 microprocessor-based system which includes a CPU 10, a keyboard 20, a communication interface 30, an LCD screen 40, an LCD driver 50 for driving the LCD screen 40, a ROM unit 70, and a RAM unit 80. In the CD65 system, the direction keys (not shown) on the keyboard 20 are used as the cursor position control device, but other devices such as mouse or joysticks also are usable. The architecture of the CD65 system is conventional, so that description thereof will not be further detailed. The ROM unit 70 includes a slot (not shown) that accepts a special type of memory card 90 storing various kinds of software programs. The memory card 90 is about the size of a business card and can be carried easily in a pocket. The game software of the Kung-Ming Chess and Thirty-six Stratagems is stored in such a memory card. Once the memory card storing the game software is inserted in the ROM slot, the CD65 can execute the game software for the user to play the Kung-Ming Chess or to learn the Thirty-six Stratagems.

Figure 7:
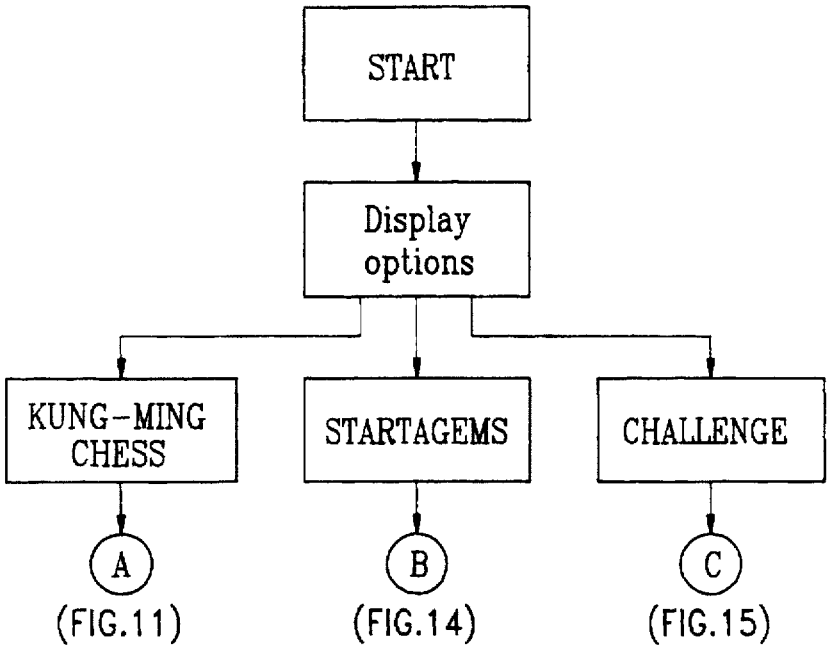
FIG. 7 is a flow diagram showing the main procedure carried out by the game software.

FIG. 7 is a flow diagram showing the procedure of the main program of the game software. It is to be noted that all the flow diagrams shown in the accompanying drawings include only those steps that are related to the essential characteristic parts of the present invention. Obvious and conventional software techniques as the displaying of preamble and copyright messages, the ways options are selected, and so one are obvious and conventional software techniques to those skilled in the art of software programming and not within the scope of the present invention, so that they are not to be detailed in this specification.

Once the game software is started, three options: KUNG-MING CHESS, STRATAGEMS, and CHALLENGE will be presented to the user for selection. The KUNG-MING CHESS option allows the user to play the Kung-Ming Chess against a large number of predefined deployments prestored in the game software. The STRATAGEMS option allows the user to select a category of the stratagems and then, from a menu of stratagems of the selected category, select a particular stratagem that the user wants to learn. The CHALLENGE option not only allows the user to learn the Thirty-six Stratagems, but also allows the user to read stories related to the stratagems. These three options will be described in more detail in the following.

The KUNG-MING CHESS Option

Figure 1:
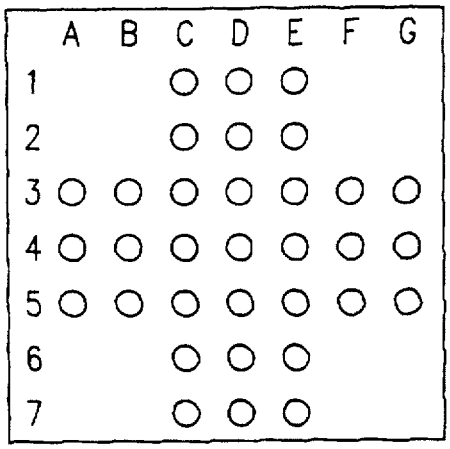
FIG. 1 shows the layout of the chessboard for the Kung-Ming Chess.
Figure 2:
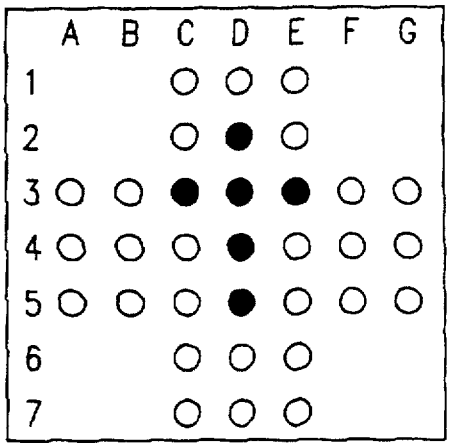
FIG. 2 shows an instance of deployment of checkers on the chessboard of FIG. 1.
Figure 3A:
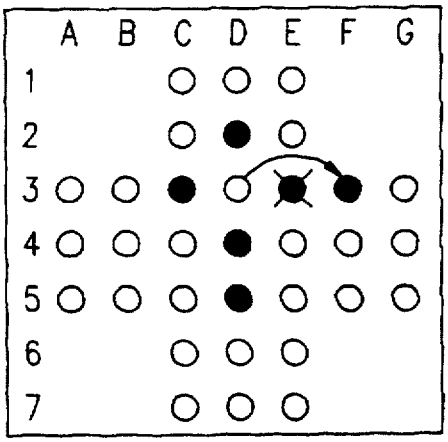
FIGS. 3A–3F illustrate a sequence of moves that can successfully defeat the deployment shown in FIG. 2.
Figure 3B:
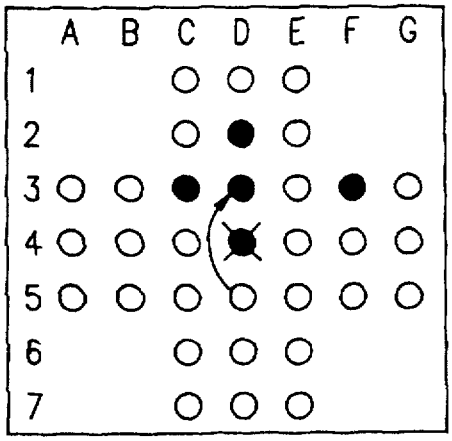
Figure 3C:
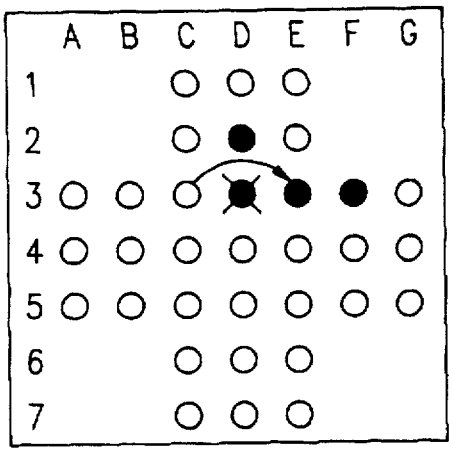
Figure 3D:
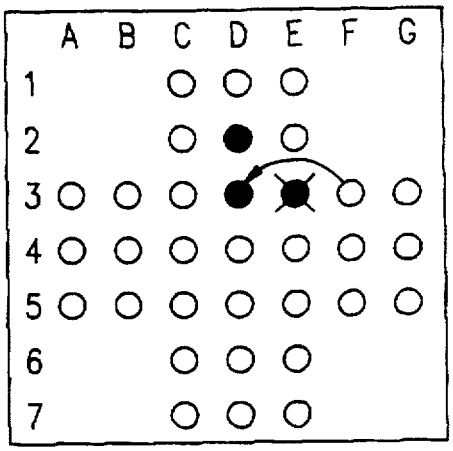
Figure 3E:
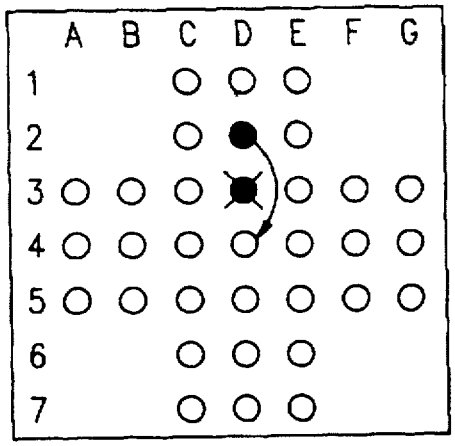
Figure 3F:
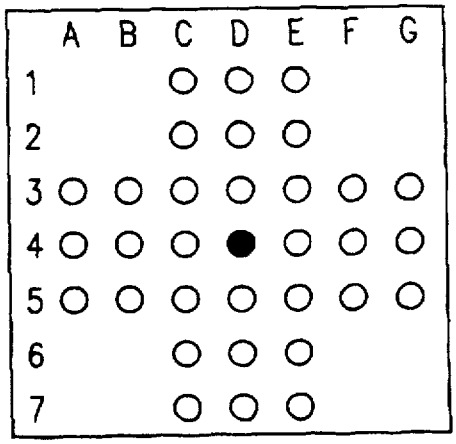
Figure 4:
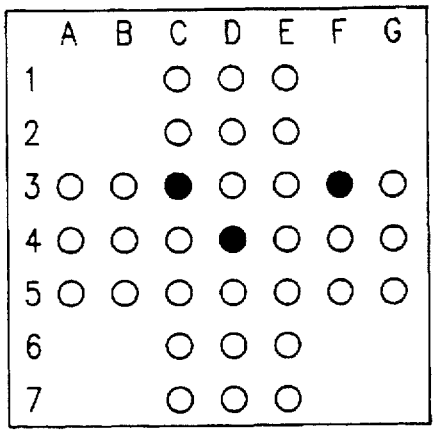
FIG. 4 shows an instance of failed attempt to defeat the deployment shown in FIG. 2.
Figure 5:
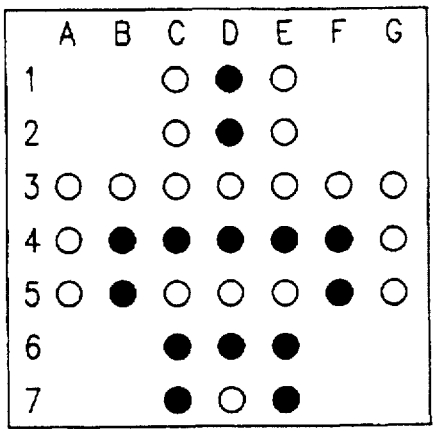
FIG. 5 shows another instance of deployment of checkers on the chessboard of FIG. 1.
Figure 8:
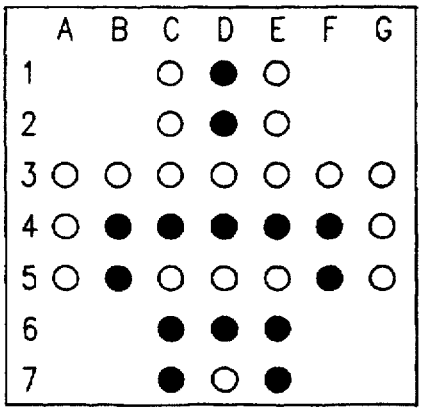
FIG. 8 is a schematic diagram showing a set of seven bytes used to represent the deployment of FIG. 5.

As shown in FIG. 8, the Kung-Ming Chess game software uses a set of seven bytes to represent each deployment, each byte corresponding to a row in the chessboard. These bytes are prestored in a table named Constant Table in the game software. The X marks in the bytes are don't-care bits each corresponding to a position in the chessboard where a box for placing a checker is not provided. In addition, the least-significant bit (LSB) of each byte is also a don't-care bit. In the preferred embodiment described here, all the don't-care bits are permanently set to 0. Elsewhere, a bit value of 1 in the bytes indicates that the corresponding box on the chessboard is to be placed with a checker, whereas a bit value of 0 indicates that the corresponding box is not to be placed with a checker. For instance, to represent the deployment of FIG. 5, the seven bytes are set with the following values: 10, 10, 00, 7C, 44, 38, and 28.

The first version of the Kung-Ming Chess game software comes with a set of 150 deployments having their byte values stored in a Constant Table. FIG. 9 shows part of the Constant Table used to store the byte values of the deployment. Each row in the Constant Table represents a particular deployment.

When the user chooses to play the Kung-Ming Chess, the game software displays a menu of various skill levels, from the beginning level which would be easy to defeat to the more advanced levels which would be difficult to defeat. After the user chooses a level, the game software displays another menu for the user to select a specific deployment to play with. The provision and selection of such options are obvious and conventional software techniques to those skilled in the art of software programming, so that they are not to be further detailed in this specification.

In preferred embodiment of the game software, each deployment is entitled metaphorically, according to the particular arrangement of the checkers on the chessboard, by the name of a particular stratagem originated from Chinese heritage (a brief introduction to some of the stratagems is included later in this specification). In a menu for user selection of a particular deployment for play, the options are shown in names of the stratagems entitling the deployments.

Figure 11:
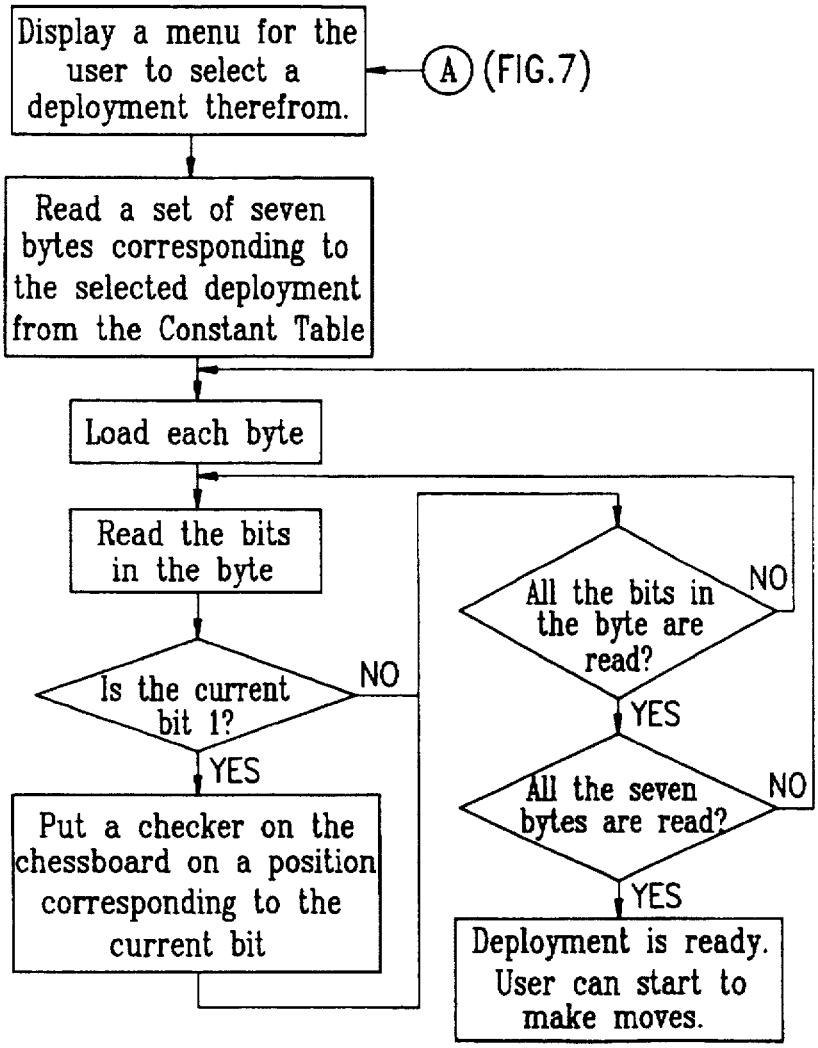
FIG. 11 is a flow diagram showing the procedure by which a user selected deployment is retrieved from database and displayed on the screen.

FIG. 11 shows the flow diagram of the procedure carried out by the game software to display a user selected deployment on the screen. For a particular deployment being selected by the user, the game software retrieves the corresponding set of seven bytes from the Constant Table. The bits in the bytes are then scanned one by one. If a bit is 1, the game software then displays an icon of the checker on the corresponding position on the chessboard. After the entire deployment is displayed on the chessboard, the game software will prompt the user to make moves.

Figure 10:
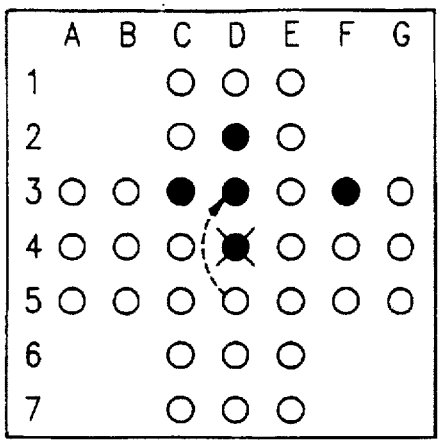
FIG. 10 is a schematic diagram used to depict a curved route along which the move of a checker on the screen is made.

As shown in FIG. 10, it is an important aspect of the present invention that the move of a checker to another position shown on the screen is along a curved route that bypass the adjacent checker being selected for removal.

Figure 12:
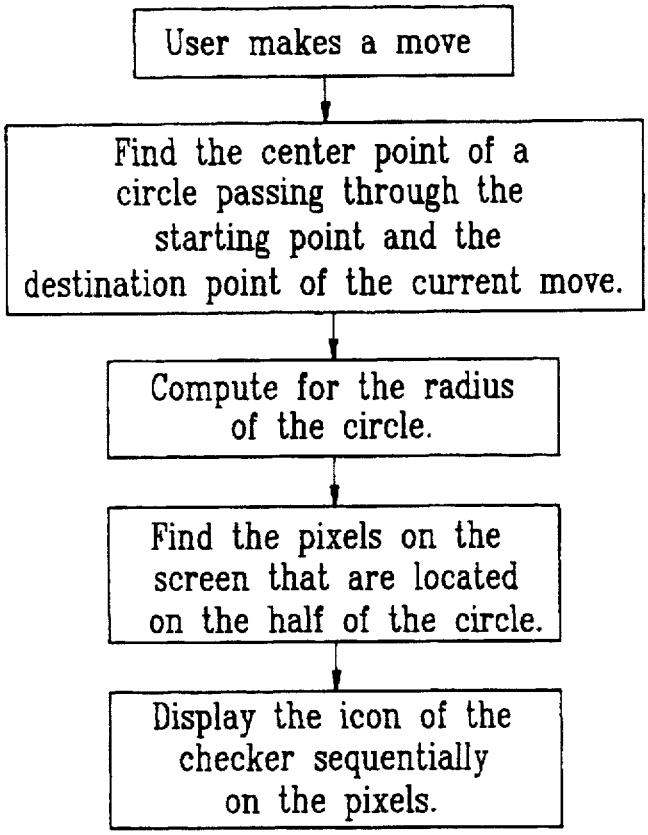
FIG. 12 is a flow diagram showing the procedure by which a checker is moved along a curved route depicted in FIG. 9 to another position on the chessboard.

Further, FIG. 12 shows the flow diagram of the procedure to move a checker along a curved route to another position. In this procedure, the game software first finds the center point (a pixel on the screen) of a circle passing through the starting position (D5 in the case of FIG. 10) and the destination position (D3 in the case of FIG. 10). The game software then computes for the radius of the circle to thereby finds a number of pixels on the left half part of the circle as indicated by the dotted arrow in FIG. 10. Finally, the game software displays the icon of the selected checker progressively on the pixels so as to show an effect of moving the selected checker along a curved route from the starting position to the destination position.

If the user successfully defeat a deployment, the game software will pop up a cheering message; whereas failed, the game software will pop up an encouragement message. The displaying of such messages are obvious techniques to those skilled in the art of software programming, so that detailed description thereof will not be given.

Figure 13A:
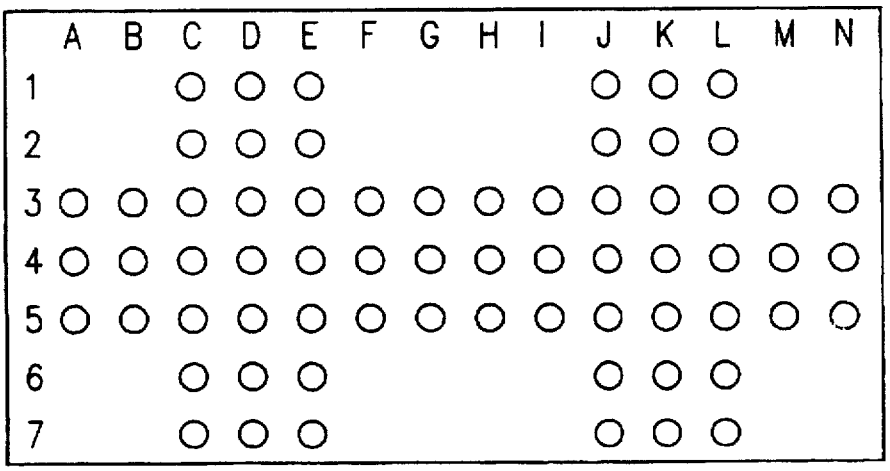
FIGS. 13A–13B show two variations of the chessboard for the Kung-Ming Chess.
Figure 13B:
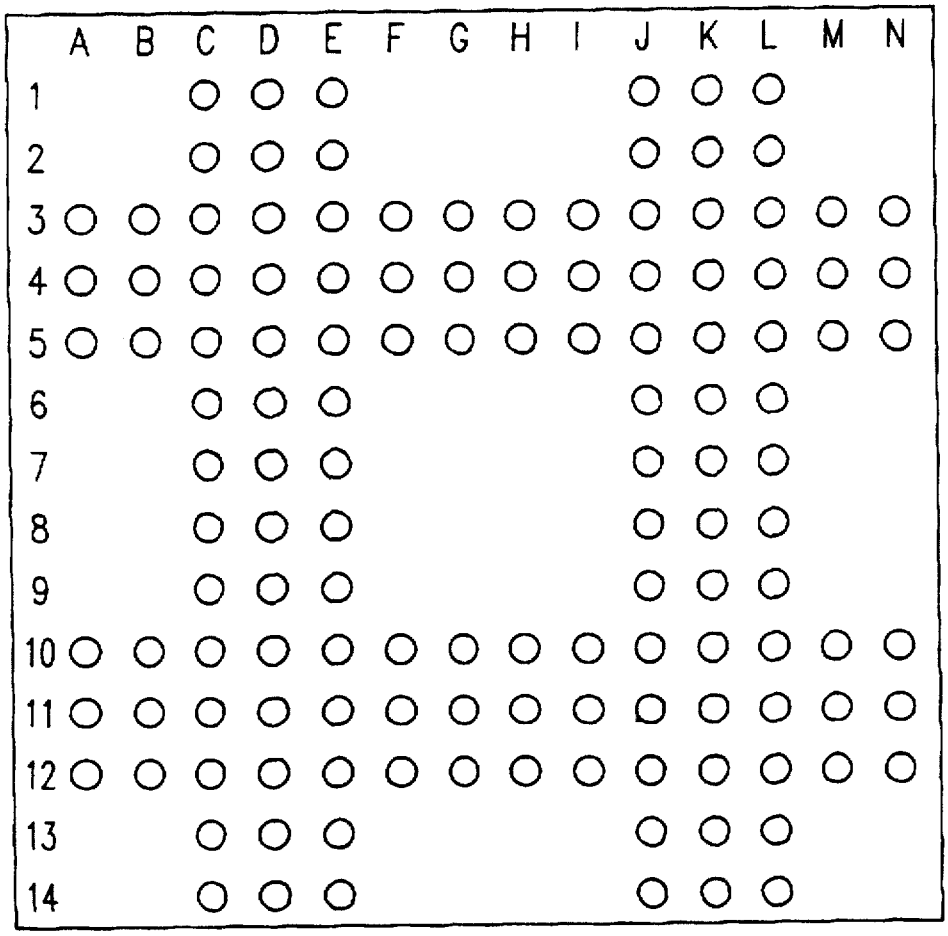

Various modifications are possible to the Kung-Ming Chess game software. For example, as shown in FIGS. 13A–13B, the chessboard for the Kung-Ming Chess can be modified with at least two variations. Numerous other variations are possible.

Moreover, on the chessboard of the Kung-Ming Chess, some positions can be designed as a "trap" where no checkers can be placed. Any position that is designated as a trap is displayed on the screen with, for example, a "x" mark indicative of a forbidden zone. The provision of the traps would make the deployment more difficult to defeat and thus the game would be more fun to play.

The STRATAGEMS Option and the CHALLENGE Option

As mentioned earlier, the STRATAGEMS option allows the user to learn the Thirty-six Stratagems and the CHALLENGE option not only allows the user to learn the Thirty-six Stratagems, but also allows the user to read related stories about the stratagems.

"The Thirty-six Stratagems" is a famous set of artifices originated far back in the Chinese history, which were devised by such wise men as Chuko Liang mentioned above in the war time so as to gain advantages over their opponents or to protect themselves from being defeated and captured.

The Thirty-six Stratagems are further classified into six categories: (1) winning stratagems, (2) battling stratagems, (3) attacking stratagems, (4) melee stratagems, (5) blitzkrieg stratagems, and (6) defeat stratagems. All the thirty-six stratagems were derived from actual historical events in Chinese history. For a particular stratagem, there could be numerous historical events in which the stratagem was used so as to achieve a desired goal. For readers who are not familiar with the Thirty-six Stratagems, reference books on Chinese heritage might be helpful.

Although the Thirty-six Stratagems were originally devised for military purposes, they are still being widely derived in various forms for use today as in political campaigns, social affairs, business competitions, sports games, and so on, where one tries to gain edges over the opponent.

Traditionally, the learning of the Thirty-six Stratagems is through books, which is not a convenient way if cross-references are to be frequently made over several volumes of books. There exists therefore a need for an on-line way of learning the Thirty-six Stratagems on a portable microprocessor-based system.

As mentioned earlier, the Kung-Ming Chess game software comes with a set of over 150 deployments each entitled with the name of a particular stratagem. Stratagems including those from the Thirty-six Stratagems are used to entitle the deployments. It is therefore a main feature of the Kung-Ming Chess game software that the user can learn these stratagems while playing the Kung-Ming Chess.

Figure 14:
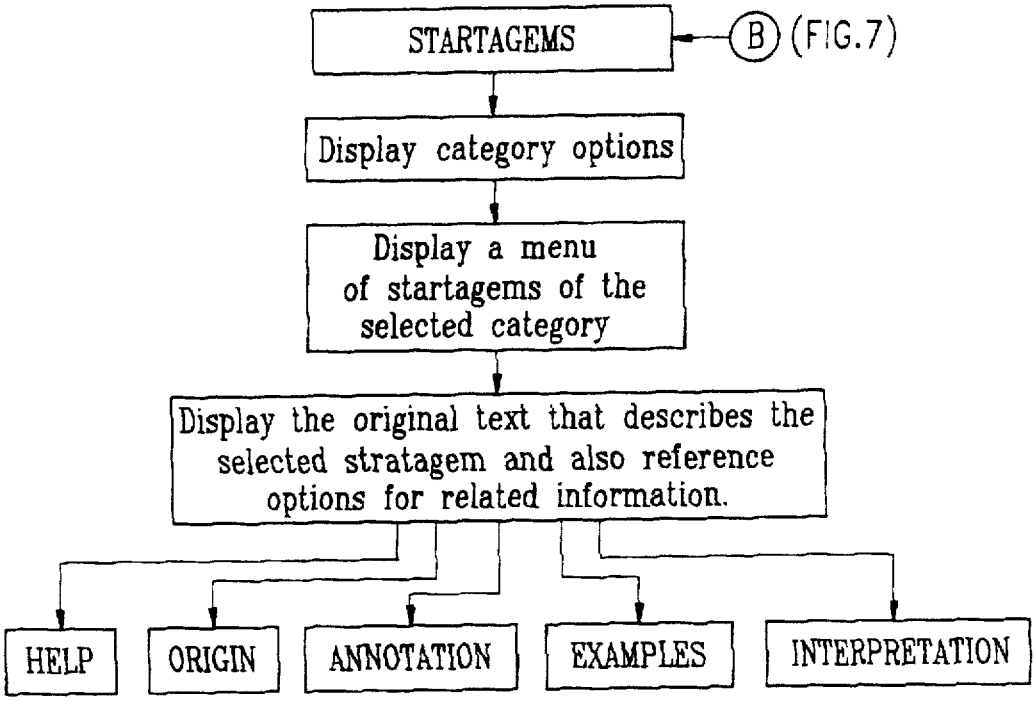
FIG. 14 is a flow diagram showing the procedure carried out by the game software in the STRATAGEMS option.

Referring to FIG. 14, in the STRATAGEMS option the user is prompt first to select which category of stratagems is of his/her interest (which includes a first category of winning stratagems, a second category of battling stratagems, a third category of attacking stratagems, a fourth category of melee stratagems, a fifth category of blitzkrieg stratagems, and a sixth category of defeat stratagems). After that, the game software will display a menu of stratagems of the selected category. The user is then prompt to select one stratagem of his/her interest and then the game software will display the information about the selected stratagem (the original text describing the stratagem) along with additional reference options including HELP, ORIGIN, ANNOTATIONS, EXAMPLES, and INTERPRETATION on the bottom of the screen. These options can be activated respectively by the function keys F1, F2, F3, F4, and F5 on the keyboard. The ORIGIN option displays information about the origin of the selected stratagem, the ANNOTATIONS option displays a commentary note about the selected stratagem, the EXAMPLES option displays examples of the practical application of the selected stratagem in actual historical events, and the INTERPRETATION option displays an interpretive description about the selected stratagem.

Figure 15:
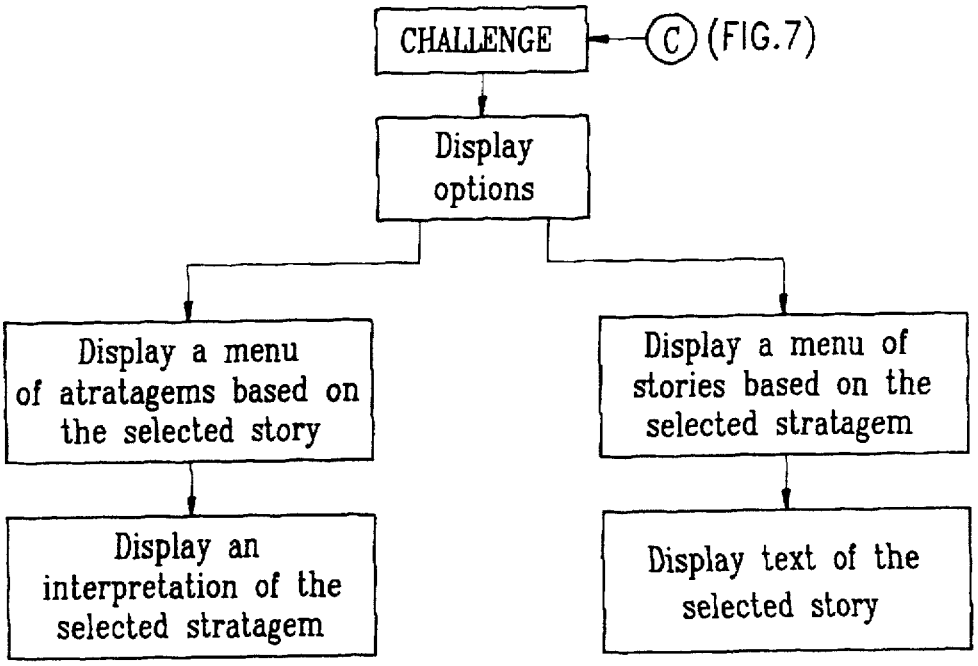
FIG. 15 is a flow diagram showing the procedure carried out by the game software in the CHALLENGE option.

Referring to FIG. 15, the CHALLENGE option further includes two sub-options, which allow the user to either learn stratagems based on a selected story or to read stories related to a selected stratagem. In the first sub-option, the game software displays a menu of stratagems related to a user selected story so as to allow the user to select one stratagem of his/her interest therefrom. In the second sub-option, the game software displays a menu of stories related to a user selected stratagem so as to allow the user to select one story of his/her interest therefrom.

Figure 16A:
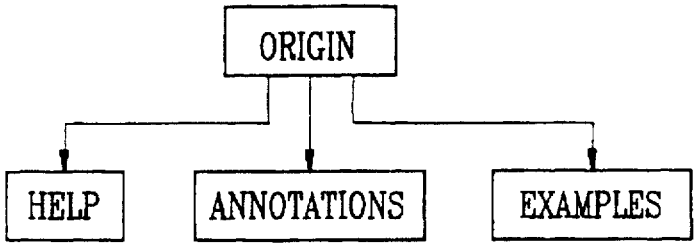
FIGS. 16A–16C are flow diagrams showing available reference options for the user to learn more about the Thirty-six Stratagems.
Figure 16B:
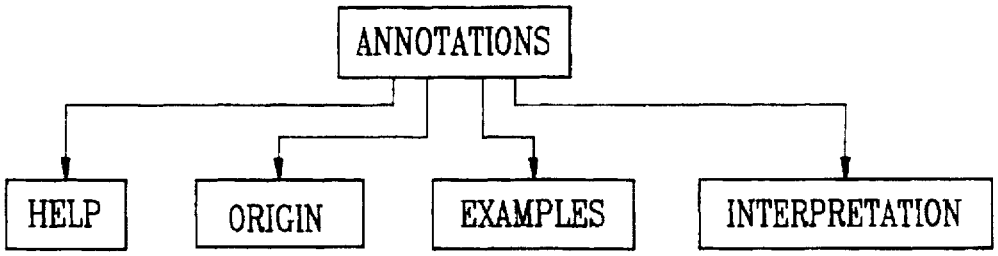
Figure 16:
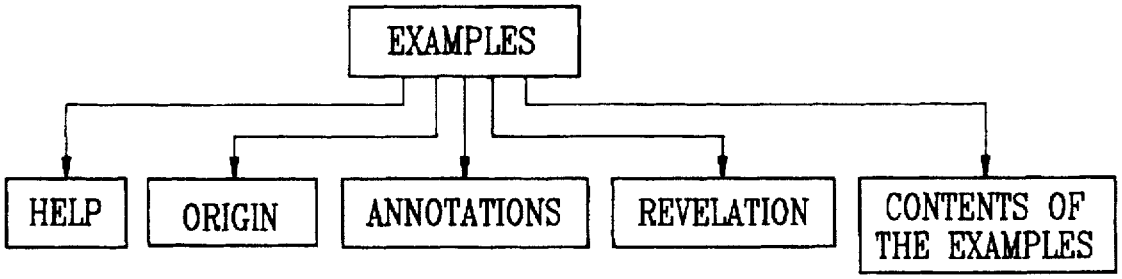

It is usually an important feature of on-line electronic books that additional reference options are allowed in the current displayed topic. FIGS. 16A–16C schematically depicts the structure of reference options provided in the game software for learning the Thirty-six Stratagems. As shown in FIG. 16A, the displaying of the ORIGIN information further includes such reference options as HELP, ANNOTATIONS, and EXAMPLES; as shown in FIG. 16B, the display of the ANNOTATIONS information includes such reference options as HELP, ORIGIN, EXAMPLES, and INTERPRETATION; and as shown in FIG. 16C, the displaying of the EXAMPLES information includes such reference options as HELP, ORIGIN, ANNOTATIONS, REVELATION, and so on.

All the records containing the foregoing pieces of information are stored in a database stored in the memory card 90 (FIG. 6). To gain access to these records, it is an important aspect of the present invention that an index table method is used to address the location of these records in the database.

Figure 17:
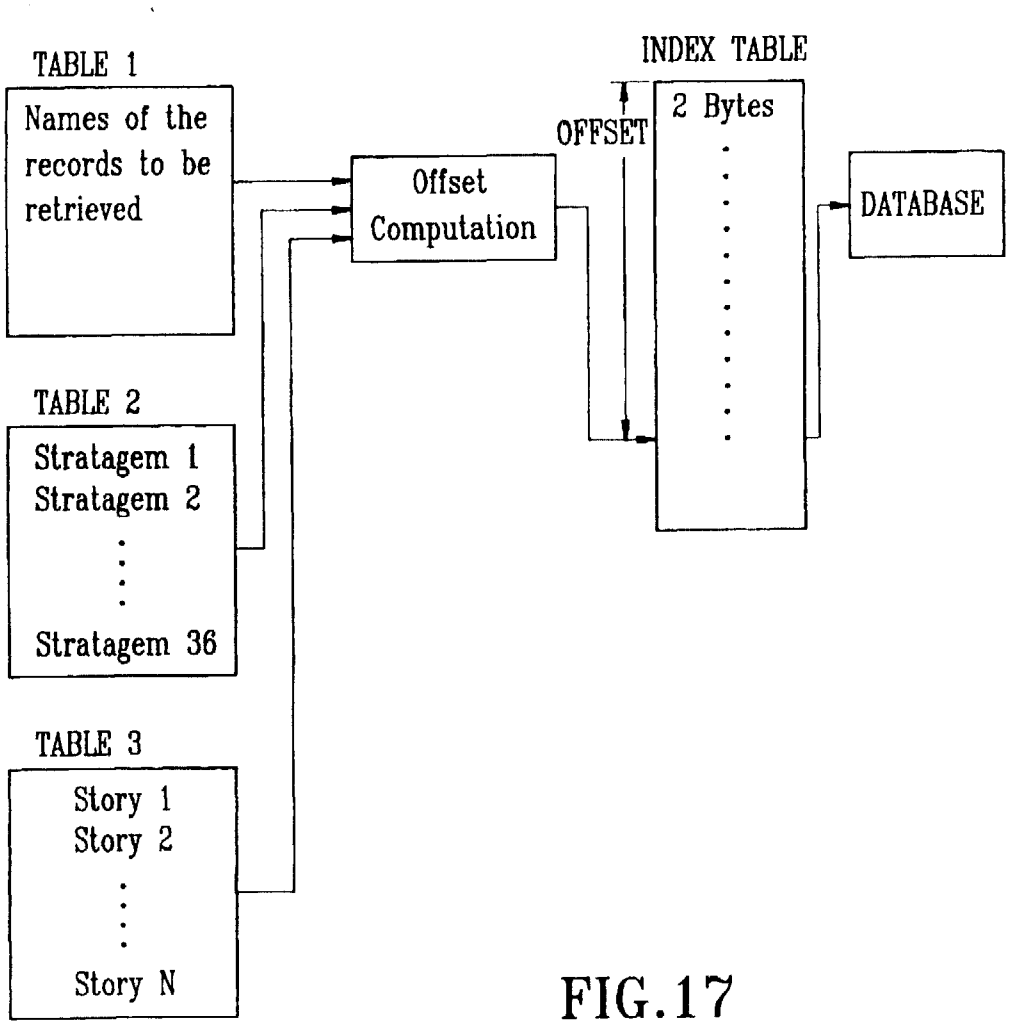
FIG. 17 is a schematic diagram showing an index table method used by the game software to retrieve data from the database.

FIG. 17 shows a schematic diagram depicting how the game software retrieve the desired record from the database. The game software includes three tables: TABLE 1 for storing a list of the names of the records to be retrieved, TABLE 2 for storing a list of the names of the thirty-six stratagems, and TABLE 3 for storing a list of the names of stories related to the thirty-six stratagems.

Figure 18:
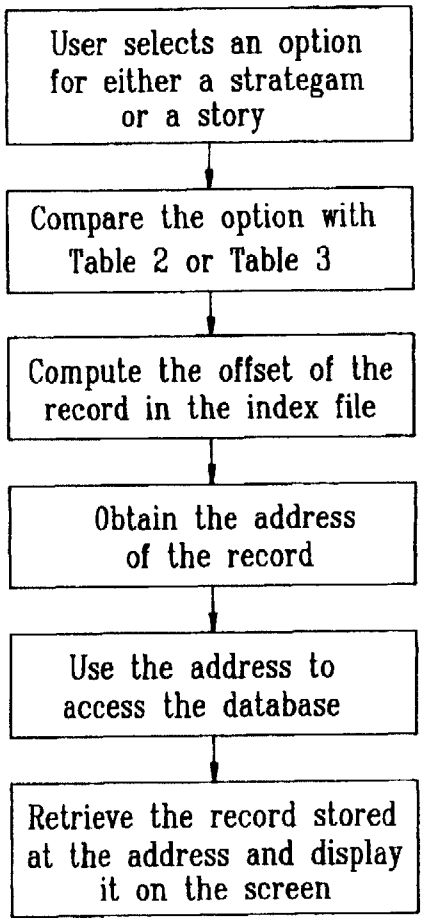
FIG. 18 is a flow diagram showing the procedure of retrieving a record from the database of the game software.

Referring also to FIG. 18, when the user choose to read the contents of a record, the game software first compute for the value of the offset in the index table. There are used three variables X, Y, and Z, in which X indicates which category of stratagems is being selected, Y indicates which stratagem of the selected category is being selected, and Z indicates which of the following options: ORIGIN, ANNOTATIONS, EXAMPLES, and INTERPRETATION is being selected. The values of the variables X and Y are directly defined by the game software based on user's selected option and that of the variable Z is directly defined by the pressing of the corresponding function keys. With the values of these variables known, the game software then computes for the offset value in accordance with the following equations:

$$ee=(y*11+z-1)$$

$$addr_i=x*4*11*6$$

$$addr_i=addr_i+ee$$

where addr_i represents the value of the offset.

With the offset value known, the game software can then use it in the index table to obtain the actual address of the desired record in the database and retrieve the desired record from the database and display it on the screen.

Moreover, the game software computes for the offset value for HELP in accordance with the following equations:

$$addr_i=(x-4)*4$$

With the offset value known, the game software can then use it in the index table to obtain the actual address of the desired HELP record in the database and retrieve the desired record from the database and display it on the screen.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A method for a user to play Kung-Ming Chess on a microprocessor-based system having at least a CPU, a memory unit, a screen, and a cursor position control device, said method comprising the following steps of:

(1) displaying a Kung-Ming Chess chessboard having an array of checker boxes on the screen;

(2) retrieving selectively a deployment of checkers from a database storing a predefined set of deployments and placing the selected deployment on the Kung-Ming Chess chessboard, each deployment being represented by at least seven bytes, each bit in said seven bytes representing whether a checker is to be placed on a corresponding position on the Kung-Ming Chess chessboard, and at least a position on the Kung-Ming Chess chessboard can be designated as a trap where no checkers can be placed;

(3) prompting the user to move the checkers on the Kung-Ming Chess chessboard;

(4) making a move so as to displace a selected checker on a starting position over an adjacent checker to a destination position two checker boxes away from the starting position and then clearing the adjacent checker; and (5) repeating step (4) until the user defeat the deployment or more than two checkers are left on the chessboard but the user is unable to move any checkers.

2. A method as claimed in claim 1, wherein in said Step (2) a bit value of 1 indicates that a checker is to be placed on a corresponding position on the chessboard.

3. A method as claimed in claim 2, wherein the least-significant bit in each byte is a don't-care bit permanently set to 0.

4. A method as claimed in claim 1, wherein in said Step (4) the move is made along a curved route obtained by the following steps of:

(a) finding the center point of a circle passing through the starting position and the destination position;

(b) computing for the radius of the circle;

(c) finding a number of pixels on half part of the circle; and (d) displaying an icon of the selected checker progressively on the pixels so as to show an effect of moving the selected checker along a curved route from the starting position to the destination position.

5. A method as claimed in claim 1, further comprising the following steps of:

(1) displaying a menu of categories of stratagems for the user to select one category therefrom;

(2) displaying a menu of stratagems of the selected category for the user to select one stratagem therefrom;

(3) retrieving from a database a record associated with the selected stratagem in accordance with the following steps:

(i) obtaining the value of a variable X corresponding to the current stratagem category being selected;

(ii) obtaining the value of a variable Y corresponding to the current stratagem being selected;

(iii) obtaining the value of a variable Z corresponding to the current reference option being selected;

(iv) computing for an offset value in accordance with the following equations:

$$ee=(Y*11+Z-1)$$

$$addr_i=X*4*11*6$$

$$addr_i=addr_i+ee$$

where addr_i is a variable for the offset;

(v) using the offset value in an index table to obtain an address for a record storing information about the selected stratagem;

(vi) retrieving the record from the database; and (4) displaying the retrieved record on the screen for the user to read.

6. A method as claimed in claim 5, further comprising the following step of:

(i) computing for the offset value for a user-desired piece of HELP information in accordance with the following equations:

$$addr_i=(x-4)*4$$

(ii) using the offset value in an index table to obtain an address for a record storing the HELP information;

(iii) retrieving the record from the database; and (iv) displaying the retrieved record on the screen for the user to read.

7. A method for a user to play Kung-Ming Chess on a microprocessor-based system having at least a CPU, a memory unit, a screen, and a cursor position control device, said method comprising the following steps of:

(1) displaying a Kung-Ming Chess chessboard having an array of checker boxes on the screen;

(2) retrieving selectively a deployment of checkers from a database storing a predefined set of deployments and placing the selected deployment on the Kung-Ming Chess chessboard, each deployment being represented by at least seven bytes, each bit in said seven bytes representing whether a checker is to be placed on a corresponding position on the Kung-Ming Chess chessboard;

(3) displaying a menu of categories of stratagems for the user to select one category therefrom;

(4) displaying a menu of stratagems of the selected category for the user to select one stratagem therefrom;

(5) retrieving from a database a record associated with the selected stratagem;

(6) displaying the retrieved record on the screen for the user to read;

(7) prompting the user to move the checkers on the Kung-Ming Chess chessboard;

(8) making a move so as to displace a selected checker on a starting position over an adjacent checker to a destination position two checker boxes away from the starting position and then clearing the adjacent checker; and (9) repeating step (8) until the user defeat the deployment or more than two checkers are left on the chessboard but the user is unable to move any checkers.

8. A method as claimed in claim 7, wherein in said Step (2) a bit value of 1 indicates that a checker is to be placed on a corresponding position on the chessboard.

9. A method as claimed in claim 8, wherein the least-significant bit in each byte is a don't-care bit permanently set to 0.

10. A method as claimed in claim 7, wherein in said Step (5) the move is made along a curved route obtained by the following steps of:

(a) finding the center point of a circle passing through the starting position and the destination position;

(b) computing for the radius of the circle;

(c) finding a number of pixels on half part of the circle; and (d) displaying an icon of the selected checker progressively on the pixels so as to show an effect of moving the selected checker along a curved route from the starting position to the destination position.

11. A method as claimed in claim 7, wherein at least a position on the Kung-Ming Chess chessboard is designated as a trap where no checkers can be placed.

12. A method as claimed in claim 7, wherein in said Step (5) the record associated with the selected stratagem further comprising the following steps of:

(i) obtaining the value of a variable X corresponding to the current stratagem category being selected;

(ii) obtaining the value of a variable Y corresponding to the current stratagem being selected;

(iii) obtaining the value of a variable Z corresponding to the current reference option being selected;

(iv) computing for an offset value on accordance with the following equations:

$$ee=(Y*11+Z-1)$$

$$addr_i=X*4*11*6$$

$$addr_i=addr_i+ee$$

where addr_i is a variable for the offset;

(v) using the offset value in an index table to obtain an address for a record storing information about the selected stratagem; and (vi) retrieving the record from the database.

13. A method as claimed in claim 12, further comprising the following step of:

(i) computing for the offset value for a user-desired piece of HELP information in accordance with the following equations:

$$addr_i=(X-4)*4$$

(ii) using the offset value in an index table to obtain an address for a record storing the HELP information;

(iii) retrieving the record from the database; and (iv) displaying the retrieved record on the screen for the user to read.

* * * * *